United States Patent [19]

Fehlmann et al.

[11] 4,168,461

[45] Sep. 18, 1979

[54] VOLTAGE REGULATOR PROVIDING WIDE RANGE OF VOLTAGE REGULATION

[75] Inventors: Hans R. Fehlmann, Pittsfield, Mass.; Robert H. Brennan, Conover, N.C.

[73] Assignee: General Electric Company, Philadelphia, Pa.

[21] Appl. No.: 865,058

[22] Filed: Dec. 27, 1977

[51] Int. Cl.[2] ..... G05F 1/14

[52] U.S. Cl. ..... 323/44 R; 323/43.5 R; 336/192

[58] Field of Search ..... 323/43.5 R, 48, 49, 323/120, 44 R; 336/147, 192

[56] References Cited

U.S. PATENT DOCUMENTS

| | | | |
|---|---|---|---|
| 3,179,875 | 4/1965 | Keats | 323/43.5 R |
| 3,440,586 | 4/1969 | Goodman et al. | 323/49 X |
| 3,448,340 | 6/1969 | Lewis | 336/147 X |
| 3,681,728 | 8/1972 | Mitchell et al. | 336/192 X |
| 3,691,495 | 9/1972 | Conway | 323/43.5 R |

OTHER PUBLICATIONS

Allis-Chalmers Transformer Reference Book, "Transformers in Parallel", 1940, pp. 13-18.

Allis-Chalmers Engineering Review, vol. 33, No. 1, 1968, pp. 14-17.

*Primary Examiner*—A. D. Pellinen

*Attorney, Agent, or Firm*—William Freedman; Carl L. Silverman; Francis X. Doyle

[57] ABSTRACT

A voltage regulator to provide a wide range of regulation, especially useful with process control. The regulator is provided with an extra bushing connected to the exciting winding of the regulator. By this means two or more regulators may be connected with their exciting windings in parallel and their series windings in series to provide a desired wide range of regulation. The invention also encompasses a selector switch so that the regulator operating at the top of the regulating range may be interchanged with one or more other regulators to alternate the tap-changing duty among the various regulators. Automatic operation of the regulators is disclosed.

3 Claims, 4 Drawing Figures

VOLTAGE REGULATOR PROVIDING WIDE RANGE OF VOLTAGE REGULATION

FIELD OF INVENTION

This invention relates to voltage regulators, and more particularly, to three-phase voltage regulators that can be connected to provide a wide range of output power for process control.

As is well known to those skilled in the chemical and metal processing field, many processes require a wide range of power control for such processes. In many instances this is provided by step- or induction-type voltage regulators. However, many times an insufficient range has been available from the step regulators. The induction-type regulators are expensive and difficult to accurately control. It has been discovered that an accurate, wide range of regulation can be obtained by using three-phase step-voltage regulators connected together to provide an increased number of steps of regulation.

It is, therefore, one object of this invention to provide a novel connection for a plurality of three-phase voltage regulators to provide an improved range of regulation.

A further object of this invention is to connect a plurality of step regulators together so that their step or series windings are connected in series to combine their steps of regulation as an output to control a process.

SUMMARY OF THE INVENTION

In carrying out this invention in one form the exciting winding of three-phase voltage regulators are each provided with a separate bushing, while the regular-source bushing is connected only to the series winding. A plurality of three-phase regulators are connected with the exciting winding of each phase in parallel and the series or step winding of each phase in series. By this means, the output regulation can be increased by the number of additional steps in each series. Control means are provided to change the order of the series windings to insure that each set of series windings shares the tap-changing duty. The control means can be automated if desired.

The invention which is sought to be protected will be particularly pointed out and distinctly claimed in claims appended hereto. However, it is believed that this invention, and the manner in which its various objects and advantages are obtained, as well as other objects and advantages thereof, will be better understood by reference to the following detailed description of a preferred embodiment, particularly when considered in the light of the accompanying drawings.

DESCRIPTION OF THE PREFERRED EMBODIMENT OF THE INVENTION

As earlier mentioned, this invention utilizes three-phase voltage regulators connected together to provide a wide range of regulation to a given process, such as chemical or metal refining. The desired range can be provided by connecting as many regulators as necessary for such range. For example, if it is desired to provide 96 regulation steps to control a chemical cell line, three, three-phase thirty-two step regulators can be combined to provide the desired ninety-six steps of regulation.

Figure 1:
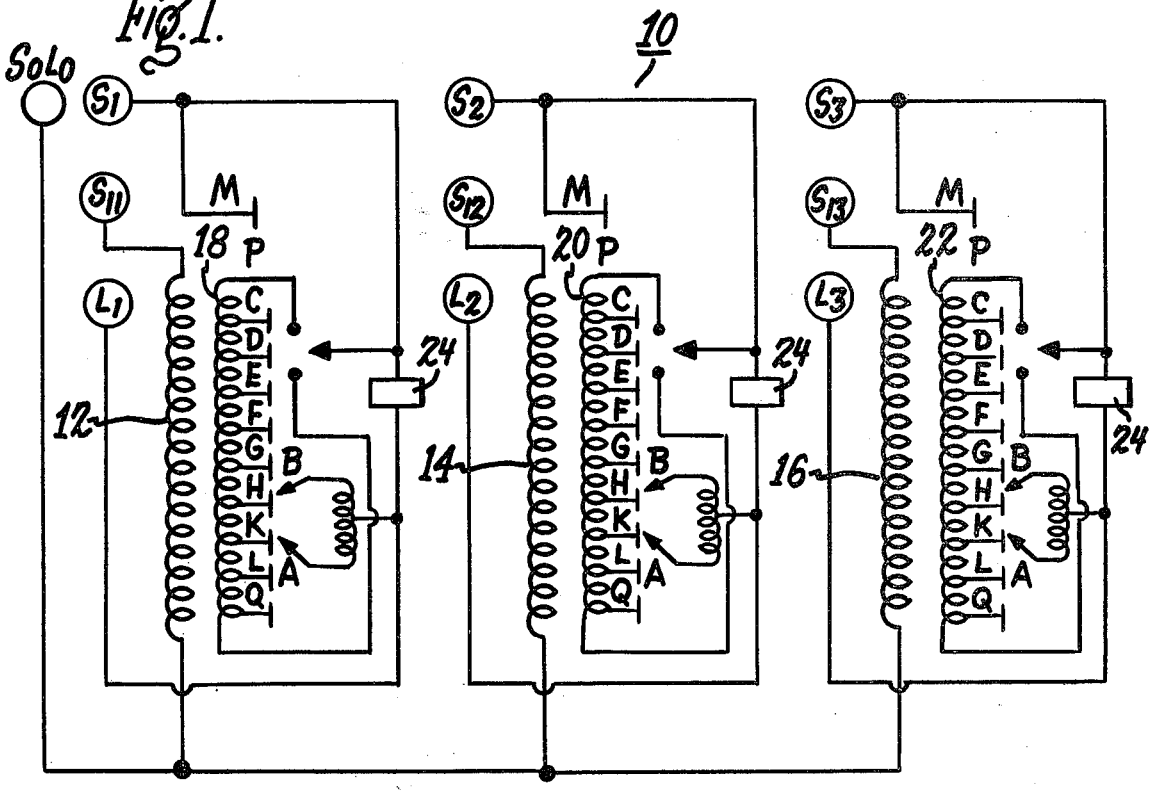
FIG. 1 is a schematic drawing of a three-phase voltage regulator showing the application of this invention in one form to such regulator.

Reference will now be made to the drawings, in which like numerals are used to indicate like parts throughout the various figures. Referring first to FIG. 1, there is shown, in schematic form, a three-phase voltage regulator constructed according to a preferred embodiment of this invention. As can be seen, the three-phase regulator 10 includes three exciting windings 12, 14, and 16 and three series windings 18, 20, and 22. The exciting windings 12, 14, and 16 are connected between the neutral bushing SoLo and the respective bushings $S_{11}$, $S_{12}$, and $S_{13}$. The series windings 18, 20, and 22 are connected respectively, between S1 L1, S2 L2, and S3 L3, as shown. As is well known, blocks 24 in each circuit is a nonlinear resistor. The operation of the three-phase regulator of FIG. 1 is well known and will not be described in this application. The important feature of the regulator of FIG. 1 is that a separate bushing, that is, $S_{11}$, $S_{12}$, and $S_{13}$ is used for the exciting windings 12, 14, and 16, respectively.

Figure 2:
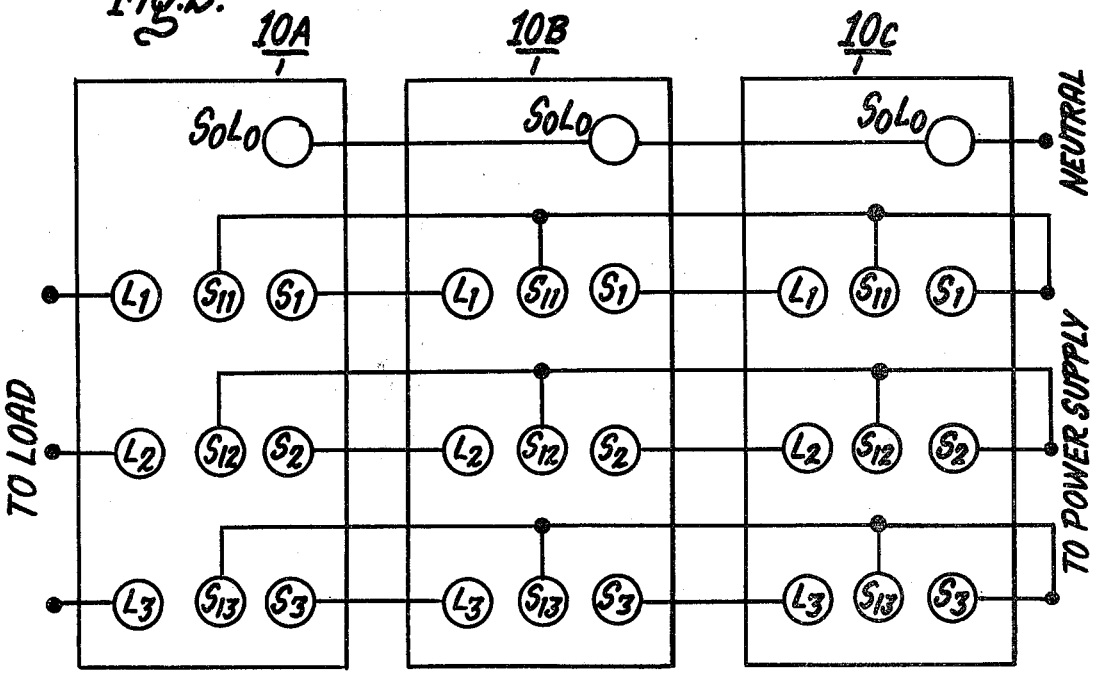
FIG. 2 is a representational drawing of the tops of three separate three-phase voltage regulators, each as shown schematically in FIG. 1, and showing the connections according to the preferred embodiment of this invention.

Referring now to FIG. 2, the method of connecting regulators according to this invention will now be described. As is shown in FIG. 2, three, three-phase regulators are provided, 10A, 10B, and 10C. Each regulator is as shown in FIG. 1. According to the preferred embodiment of this invention, the regulators 10A, 10B, and 10C are connected with their exciting windings in parallel and their series windings are series. This is accomplished by connecting all of the neutral bushings SoLo together, all of the $S_{11}$ bushings together and to the power supply, all $S_{12}$ bushings together and to the power supply, and all $S_{13}$ bushings together and to the power supply. As will be apparent this will place the exciting windings of each phase of each regulator in parallel with the comparable exciting windings of each other regulator. The series or step windings of each phase of each regulator are connected in series with the comparable step winding of each other regulator by connecting the L bushings of the series windings of one regulator to the S bushings of the next regulator, as is clearly shown in FIG. 2. The L or load bushing of the end regulator, that is regulator 10A, is connected to the load to be regulated. While three regulators are shown in FIG. 2, it will be apparent that more or less may be used to provide a desired range of regulation.

Figure 3:
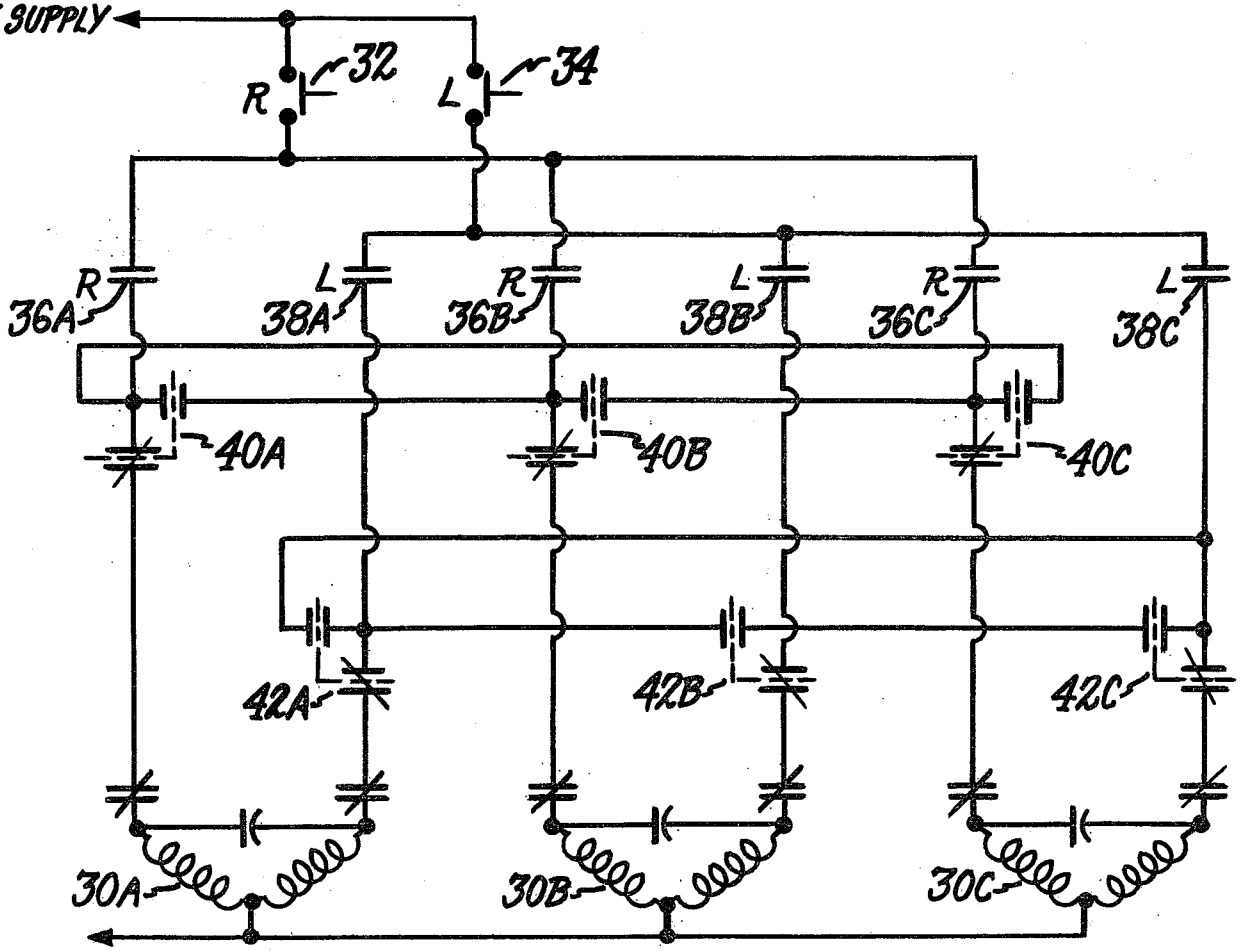
FIG. 3 is a schematic of a preferred controlled circuit according to this invention for controlling the output of the regulators in FIG. 2.

A preferred form of control circuit to raise and lower the regulators to provide the desired regulation is shown in FIG. 3. As will be apparent, motor 30A is the motor for regulator 10A, motor 30B for regulator 10B, and motor 30C for regulator 10C. Also shown, is the raise switch 32 and the lower switch 34. Each motor is provided with its own raise and lower contacts as part of selector switch 36–38, as is shown. As can be seen in FIG. 3 contacts 36A, raise and 38A, lower are for motor 30A while contacts 36B, raise and 38B lower are for motor 30B and contacts 36C, raise and 38C, lower, are for motor 30C. Raise limit switches 40A, 40B, and 40C, and lower limit switches 42A, 42B, 42C are also provided as is shown.

If it is desired to operate the regulators in the sequence A, B, and C, then with the raise switch 32 closed, the selector switch 36–38 is positioned to close contacts 36A and 38C. In this position, the motor 30A will be energized and drive regulator 10A to move the contact of its series windings to its upper limits. This will actuate limit switch 40A to de-energize motor 30A and energize motor 30B. This will move the contact of the series winding of regulator 10B to its upper limits. This, in turn will actuate limit switch 40B to de-energize motor 30B and to energize motor 30C. Regulator 10C will then move its step winding contacts to the desired power output. Obviously, to lower the regulators, the reverse action takes place, first lowering regulator 10C, then 10B and finally 10A.

Figure 4:
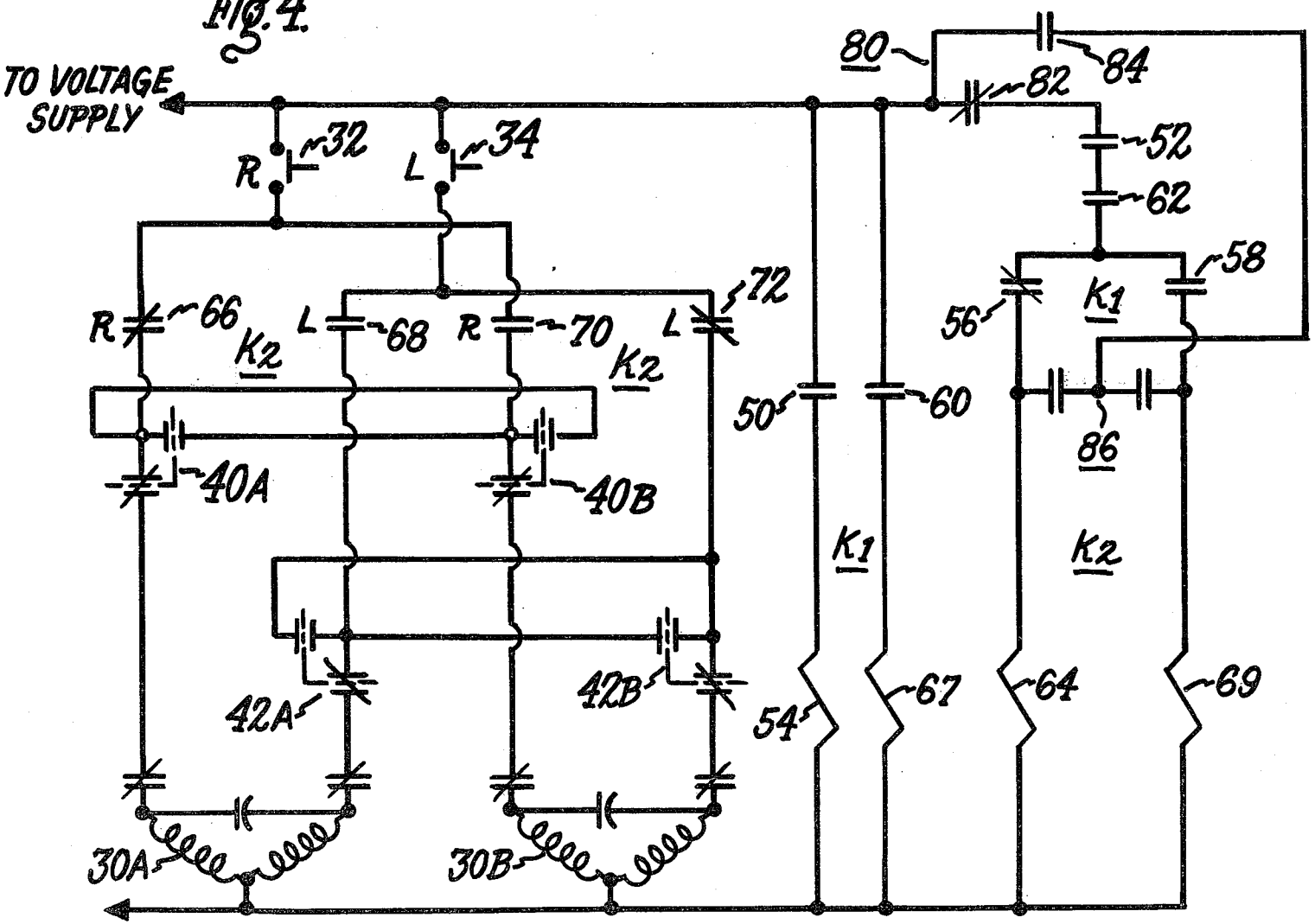
FIG. 4 is a schematic of an automatic control circuit according to this invention.

As is well known, in many instances of process control, it is the final few steps of the regulator that see the most duty, fluctuating up and down to maintain the desired output. Thus, in the connected regulators in the present invention it is the step winding of the output regulator that sees the most tap changing duty. To equalize this duty between the regulators, selector switch 36–38 may be used to alternate the sequence of the regulators. For example, if selector switch 36–38 is set so that contacts 36B and 38A are closed, then the regulators will be actuated in the sequence B, C, and A. With selector switch 36–38 set with contacts 36C and 38B closed, the sequence will be C, A, and B. Obviously, more or less regulators can be used and the selector switch 36–38 provided with sufficient contacts to obtain any desired sequence of operation. If desired, the motor control circuit may be automatic, as is shown in FIG. 4. Only two regulator motors, 30A and 30B, are shown in FIG. 4, to simplify the illustration and the description thereof. However, it will be apparent that as many additional regulator motors may be included, as desired. Insofar as the same elements are used in the circuit of FIG. 4, as is used in the circuit of FIG. 3, the same numerals will be used. The circuit of FIG. 4 is designed to alternate the sequence of the regulators, by causing the raising first of the regulator that was first lowered. Considering the circuit of FIG. 4, assume that regulator 10A, motor 30A, was first to lower. In that case, contact 50 and 52 are closed and energized coil 54 of relay K1. This would close K1 contact 56 and contact 58 would be opened, as shown. After regulator 10B, motor 30B, reaches the maximum lower position, contacts 60 and 62 will close. Closing of contact 62 will energize coil 64 of relay K2 through closed contact 56. This will set the contacts of K2, with raise contact 66 closed and lower contact 72 closed, while lower contact 68 and raise contact 70 are opened, all as shown in FIG. 4. Thus, at the next raise signal, regulator 10A, motor 30A, will raise first and regulator 10B, motor 30B, will raise second.

When the regulators return to maximum lower, regulator 10B, motor 30B, will lower first. The lowering of regulator 10B, motor 30B, will close contacts 60, 62, thus energizing coil 67 of relay K1. This will close contact 58 and open contact 56 of the relay K1. When regulator 10A, motor 30A, reaches maximum lower, contacts 50 and 52 will close. This will energize coil 69 of relay K2 to open raise contact 66 and lower contact 72 and close raise contact 70 and lower contact 68. Thus, at the next raise signal, regulator 10B, motor 30B, will raise first, followed by regulator 10A, motor 30A. An automatic manual selector switch 80 is provided, with automatic contact 82 and manual contact 84. In the manual setting of selector switch 80, the contacts of switch 86 will determine which regulator will raise first. It will be apparent that the control circuit of FIG. 4 can be used with as many regulators as is desired.

While there has been shown and described the present preferred embodiment of this invention, it will be apparent to those skilled in the art that various modifications may be made in such embodiment. It will be understood that all such changes are considered to be within the spirit and scope of the invention as it is defined in the accompanying claims.

We claim:

1. A plurality of three-phase step-voltage regulators connected to provide a wide range of voltage regulation, including first means connecting each exciting winding of each phase of each regulator in parallel with the comparable exciting winding of each phase of each other regulator, said first means comprising an extra separate bushing connected to each said exciting winding of each phase of each regulator, and second means connecting each step winding of each phase of each regulator in series with the comparable step winding of each phase of each other regulator, to provide a regulated output range equal to the sum of the steps in the plurality of connected regulators.

2. A plurality of three-phase step-voltage regulators connected to provide a wide range of voltage regulation as claimed in claim 1 in which a selector switch is provided in a control circuit to alter the sequence of raising and lowering of the connected regulators for equalizing the duty among the regulators.

3. A plurality of three-phase step-voltage regulators connected to provide a wide range of voltage regulation as set forth in claim 2 in which automatic means are provided for said selector switch whereby the first regulator to lower is the first regulator to move in the raise position.

* * * * *